US010520237B2

(12) United States Patent
Heo et al.

(10) Patent No.: US 10,520,237 B2
(45) Date of Patent: Dec. 31, 2019

(54) REFRIGERATION CYCLE COMPRISING A COMMON CONDENSING SECTION FOR TWO SEPARATE EVAPORATOR-COMPRESSOR CIRCUITS

(71) Applicant: LG ELECTRONICS INC., Seoul (KR)

(72) Inventors: Juyeong Heo, Seoul (KR); Kyeongyun Kim, Seoul (KR); Kyungseok Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 959 days.

(21) Appl. No.: 14/531,032

(22) Filed: Nov. 3, 2014

(65) Prior Publication Data

US 2015/0121949 A1 May 7, 2015

(30) Foreign Application Priority Data

Nov. 5, 2013 (KR) ..... 10-2013-0133254

(51) Int. Cl.

| | |
|---|---|
| ***F25B 7/00*** | (2006.01) |
| ***F25B 39/02*** | (2006.01) |
| ***F25B 39/04*** | (2006.01) |
| ***F25D 11/02*** | (2006.01) |
| ***F25B 5/02*** | (2006.01) |

(Continued)

(52) U.S. Cl.

CPC ..... *F25D 11/022* (2013.01); *F25B 5/02* (2013.01); *F25B 39/04* (2013.01); *F25B 41/003* (2013.01); *F25D 17/00* (2013.01); *F25B 2400/06* (2013.01)

(58) Field of Classification Search

CPC .. F28D 1/0443; F28D 1/05391; F28D 1/0477; F28D 1/0478; F28D 1/0426; F25B 39/04; F25B 7/00; F28F 1/126

See application file for complete search history.

(56) References Cited

U.S. PATENT DOCUMENTS

| | | |
|---|---|---|
| 3,392,541 A | 7/1968 | Nussbaum |
| 4,505,419 A | 3/1985 | Steeb |

(Continued)

FOREIGN PATENT DOCUMENTS

| | | |
|---|---|---|
| CN | 1478008 | 2/2004 |
| CN | 2783218 | 5/2006 |

(Continued)

OTHER PUBLICATIONS

European Office Action and Search Report dated Apr. 24, 2015 for Application No. EP 14191702, 7 Pages.

*Primary Examiner* — Filip Zec

(74) *Attorney, Agent, or Firm* — Fish & Richardson P.C.

(57) ABSTRACT

A refrigeration cycle of a refrigerator includes a first refrigeration cycle in which a first refrigerant flows along a first refrigerant tube and a second refrigeration cycle in which a second refrigerant flows along a second refrigerant tube. First and second compressors compress each of the first and second refrigerants, and a combined condenser condenses each of the first and second refrigerants. First and second expansion valves phase-change each of the first and second refrigerants passing through the combined condenser, and first and second evaporators change the refrigerant passing through each of the first and second expansion valves into a low-temperature low-pressure gaseous refrigerant.

15 Claims, 4 Drawing Sheets

(51) Int. Cl.
*F25B 41/00* (2006.01)
*F25D 17/00* (2006.01)

(56) References Cited

U.S. PATENT DOCUMENTS

| | | | | | |
|---|---|---|---|---|---|
| 4,901,791 | A * | 2/1990 | Kadle | F25B 39/04 | 165/150 |
| 5,076,353 | A * | 12/1991 | Haussmann | F25B 39/04 | 165/110 |
| 2010/0229804 | A1* | 9/2010 | Okamoto | F24H 1/145 | 122/18.2 |
| 2012/0011867 | A1* | 1/2012 | Koons | F25B 39/04 | 62/115 |

FOREIGN PATENT DOCUMENTS

| | | | | |
|---|---|---|---|---|
| DE | 2020040011489 | | 12/2005 | |
| FR | 2758615 | A1 | 7/1998 | |
| JP | 2000-283569 | | 10/2000 | |
| JP | 2001-085883 | A | 3/2001 | |
| KR | 10-2011-0071167 | A | 6/2011 | |
| NL | 106 435 | C | 6/1963 | |
| WO | WO 2012040281 | A2 * | 3/2012 | F28D 1/0461 |

* cited by examiner

REFRIGERATION CYCLE COMPRISING A COMMON CONDENSING SECTION FOR TWO SEPARATE EVAPORATOR-COMPRESSOR CIRCUITS

CROSS-REFERENCE TO RELATED APPLICATIONS

The present application claims the benefits of priority to Korean Patent Application No. 10-2013-0133254 filed on Nov. 5, 2013, which is herein incorporated by reference in its entirety.

BACKGROUND

The present disclosure relates to a refrigeration cycle of a refrigerator.

In refrigerator according to the related art, a refrigerant is transferred from one compressor into evaporators respectively disposed at rear sides of a refrigerating compartment and freezing compartment, and then, a valve disposed in each of the evaporators is adjusted in opening degree to alternately perform an operation for cooling the freezing compartment and the refrigerating compartment. Alternatively, a freezing compartment is cooled by using a single evaporator disposed on a side of the freezing compartment, and then cool air is transferred into a refrigerating compartment by using a damper.

However, in the case of the above-described structure, temperatures required for the refrigerating compartment and the freezing compartment are different from each other. Thus, to realize the temperatures required for the two storage compartments, which have a large temperature difference therebetween, in a refrigeration cycle including one compressor, the compressor may operate out of the optimum efficiency range thereof. To solve this limitation, a two-cycle refrigerator including a refrigeration cycle for a refrigerating compartment and a refrigeration cycle for a freezing compartment has been released.

However, in case of the two-cycle refrigerator, following limitations occurs as ever. That is, in the two cycles, one of the limitations is that two compressors and condensers have to be installed in a machine room. As a result, the machine room may increase in volume, and thus the storage compartment may be reduced in volume.

Also, if the two compressors and condensers are installed in the limited machine room, the condensers are limited in size and capacity to cause a limit in heat-dissipation area for dissipating heat.

In addition, when the two condensers and two compressors are disposed in the machine room, flow resistance of indoor air that forcibly flows into the machine room by a condensation fan to deteriorate heat-dissipation efficiency of the condensers.

To solve the above-described limitations of the refrigerator having the two refrigerant cycles, needs for developing a refrigerator that has a small size and high heat-dissipation efficiency due to the machine room having a limited volume are being on the rise.

SUMMARY

The present disclosure is proposed to improve the above-described limitations.

In one embodiment, a refrigeration cycle of a refrigerator including a first refrigeration cycle in which a first refrigerant flows along a first refrigerant tube and a second refrigeration cycle in which a second refrigerant flows along a second refrigerant tube includes: first and second compressors compressing each of the first and second refrigerants into a high-temperature high-pressure gaseous refrigerant; a combined condenser condensing each of the first and second refrigerants passing through the first and second compressors into a high-temperature high-pressure liquid refrigerant; first and second expansion valves phase-changing each of the first and second refrigerants passing through the combined condenser into a low-temperature low-pressure two-phase refrigerant; and first and second evaporators changing the refrigerant passing through each of the first and second expansion valves into a low-temperature low-pressure gaseous refrigerant, wherein the combined condenser includes: first and second condensation tubes constituting portions of the first and second refrigerant tubes that connect the first and second compressors to the first and second expansion valves, respectively; and heat-exchange fins contacting surfaces of the first and second condensation tubes, wherein the first and second condensation tubes share at least a portion of the heat-exchange fins, the first and second condensation tubes are bent several times to form a meander line in a state where the first and second refrigerant tubes each of which has a predetermined width and length are vertically disposed in parallel to each other, and the heat-exchange fins are inserted between the condensation tubes that are adjacent thereto.

Each of the heat-exchange fins may have the same width as that of each of the first and second condensation tubes and be bent several times in a wave form, and cusps defined at the bent portions may contact one or all of surfaces of the first and second condensation tubes.

The cusps may include an upper cusp and a lower cusp, and the heat-exchange fins may include: a first heat-exchange fin in which all of the upper and lower cusps contact the surface of the first condensation tube; a second heat-exchange fin in which all of the upper and lower cusps contact the surface of the second condensation tube; and a sharing heat-exchange fin in which one cusp of the upper and lower cusps contacts the surface of the first condensation tube, and the other cusp contacts the surface of the second condensation tube.

In a stand-alone operation mode of the first refrigeration cycle, heat exchange may be performed through the first heat-exchange fin and the sharing heat-exchange fin, in a stand-alone operation mode of the second refrigeration cycle, the heat exchange may be performed through the second heat-exchange fin and the sharing heat-exchange fin, and in a simultaneous operation mode of the first and second refrigeration cycles, the heat exchange may be performed through all of the heat-exchange fins.

The first and second condensation tubes may have the same width, and a plurality of refrigerant flow channels may be defined in the first and second condensation tubes, respectively.

The refrigeration cycle may further include: an inflow-side head connected to one end of each of the first and second condensation tubes to distribute the refrigerant into the refrigerant flow channels; an inflow port disposed on one side of the inflow-side head, the inflow port being connected to the refrigerant tube that extends from each of the first and second compressors; a discharge-side head connected to the other end of each of the first and second condensation tubes to collect the refrigerant flowing along the refrigerant flow channels; and a discharge port disposed on one side of the discharge-side head, the discharge port being connected to each of the first and second expansion valves.

One of the first and second evaporators may be a refrigerating compartment evaporator, and the other of the first and second evaporators may be a freezing compartment evaporator.

The combined condenser and the first and second compressors may be accommodated in a machine room of the refrigerator.

The first and second refrigerants may be the same kind.

The details of one or more embodiments are set forth in the accompanying drawings and the description below. Other features will be apparent from the description and drawings, and from the claims.

DETAILED DESCRIPTION OF THE EMBODIMENTS

Hereinafter, a refrigeration cycle of a refrigerator according to an embodiment will be described in detail with reference to the accompanying drawings.

Figure 1:
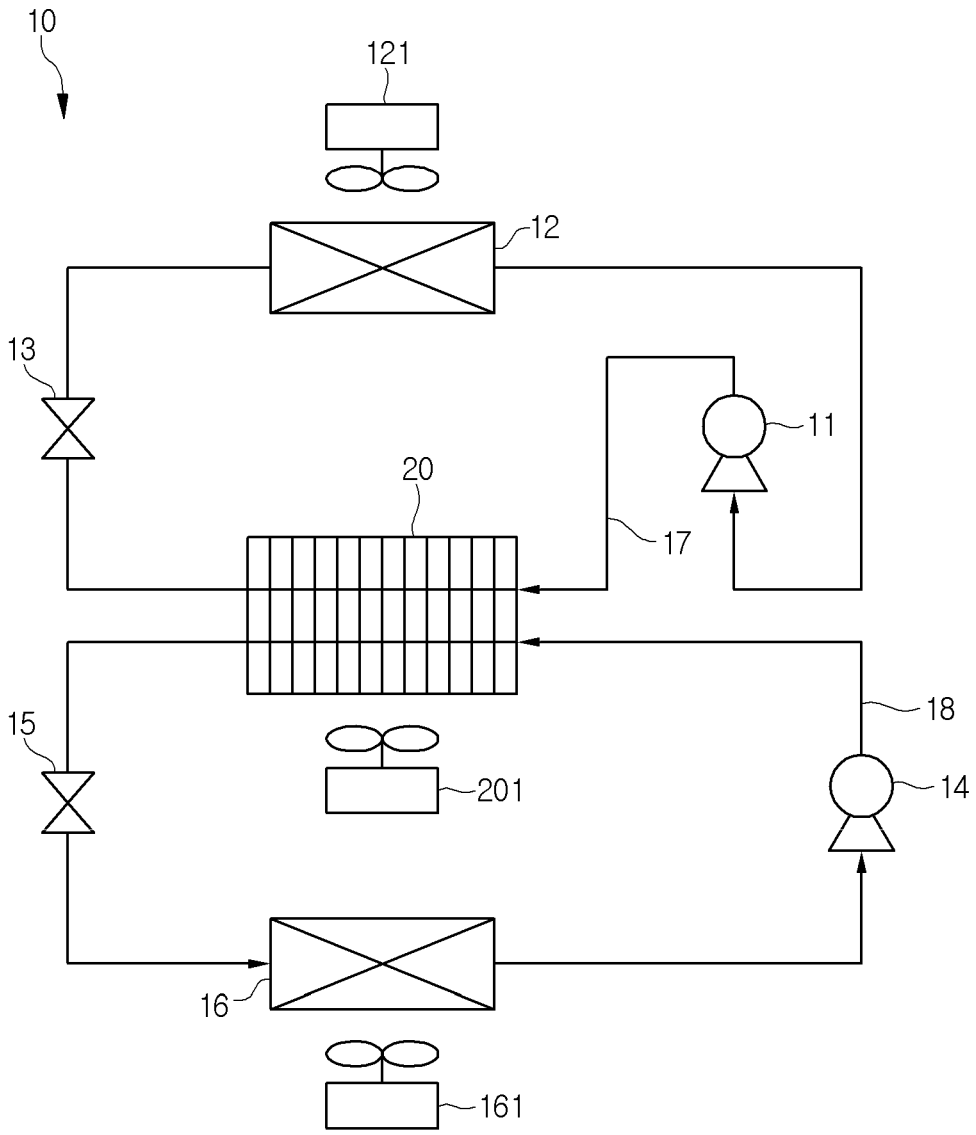
FIG. 1 is a system view illustrating a refrigeration cycle of a refrigerator according to an embodiment.

FIG. 1 is a system view illustrating a refrigeration cycle of a refrigerator according to an embodiment.

Referring to FIG. 1, a refrigeration cycle 10 of a refrigerator according to an embodiment may include a first refrigeration cycle in which a refrigerant flowing along a first refrigerant tube 17 is heat-exchanged with cool air or external air and a second refrigeration cycle in which a refrigerant flowing along a second refrigerant tube 18 is heat-exchanged with the cool air or external air. Also, a condenser of the first refrigeration cycle and a condenser of the second refrigeration cycle share heat-exchange fins. Here, the refrigerant flowing along the first refrigerant tube 17 may be defined as a first refrigerant, and the refrigerant flowing along the second refrigerant tube 18 may be defined as a second refrigerant. The first refrigerant and the second refrigerant may be the same kind.

In detail, the first refrigeration cycle may include a first compressor 11 compressing the first refrigerant into a high-temperature high-pressure gas; a second condensation part condensing the high-temperature high-pressure first refrigerant passing through the first compressor 11 into a high-temperature high-pressure liquid refrigerant; a first expansion valve 13 phase-changing the high-temperature high-pressure liquid refrigerant passing through the second condensation part into a low-temperature low-pressure two-phase refrigerant; and a first evaporator 12 absorbing heat of the refrigerant passing through the first expansion valve 13 to generate a gaseous refrigerant.

Also, the second refrigeration cycle may include a second compressor 14 compressing the second refrigerant, a second condensation part condensing the second refrigerant, a second expansion valve 15 phase-changing the second refrigerant, and a second evaporator 16.

Here, the first condensation part and the second condensation part may be defined as a combined condenser 20 because the first and second condensation parts respectively include separate refrigerant tubes and share the heat-exchange fins. Also, the first compressor 11, the second compressor 14, and the combined condenser 20 may be disposed in a machine room of the refrigerator. A condensation fan 201 may be disposed at a point that is spaced apart from the combined condenser 20. The condensation fan 201 may be disposed on a position at which air forcibly flowing by the condensation fan 201 passes through a gap defined between the heat-exchange fins of the combined condenser 20 and then is discharged to the outside of the machine room.

Also, the first evaporator 12 may be an evaporator for cooling one of the refrigerating compartment and freezing compartment of the refrigerator. The first evaporator 12 may be disposed on a rear wall of one of the refrigerating compartment and the freezing compartment, and a first evaporation fan 121 may be disposed above or under the first evaporator 12. Also, the second evaporator 16 may be an evaporator for cooling the other of the refrigerating compartment and freezing compartment of the refrigerator. The first evaporator 16 may be disposed on a rear wall of the other of the refrigerating compartment and the freezing compartment, and a second evaporation fan 161 may be disposed above or under the second evaporator 16.

Hereinafter, a structure of the combined condenser 20 and an operation state of the heat-exchange fins according to the operation mode will be described with reference to the accompanying drawings.

Figure 2:
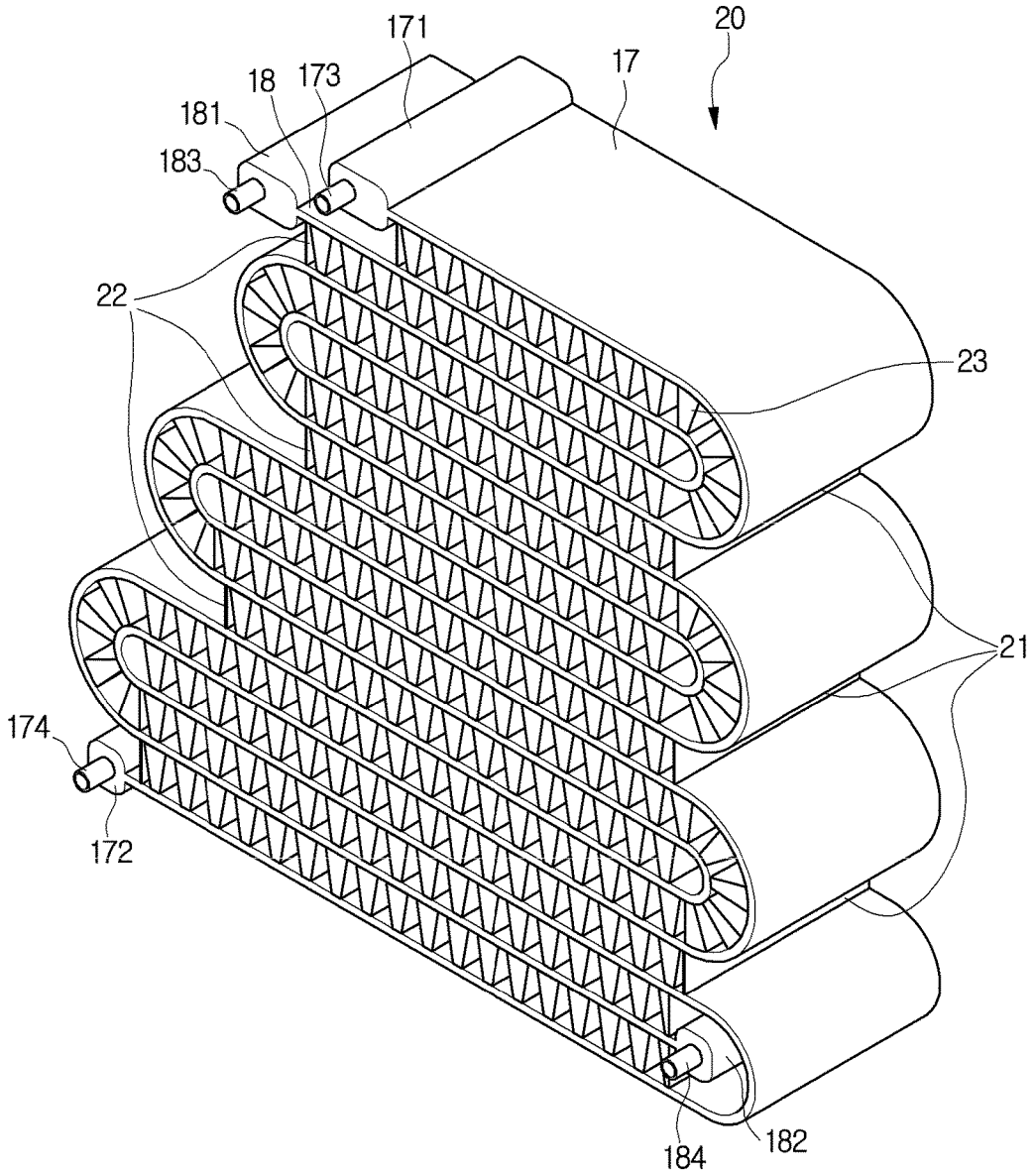
FIG. 2 is a perspective view of a combined condenser constituting the refrigeration cycle of the refrigerator according to an embodiment.

FIG. 2 is a perspective view of the combined condenser constituting the refrigeration cycle of the refrigerator according to an embodiment.

Referring to FIG. 2, the combined condenser 20 according to an embodiment has a structure in which the first and second refrigerant tubes 17 and 18 are bent several times to form a meander line in a state where the first and second refrigerant tubes 17 and 18 are vertically disposed in parallel to each other, and the heat-exchange fins are inserted between the first and second refrigerant tubes 17 and 18. Here, the tubes corresponding to the components of the combined condenser 20, i.e., the first and second refrigerant tubes 17 and 18 contacting the heat-exchange fins may be defined as first and second condensation tubes, respectively.

In detail, a portion of the heat-exchange fins may contact the first and second refrigerant tubes 17 and 18, and the other portion may contact only the first refrigerant tube or only the second refrigerant tube 18.

Inlet ends of the first and second refrigerant tubes 17 and 18 may be respectively connected to inflow-side heads 171 and 181, and outlet ends may be respectively connected to discharge-side heads 172 and 182. Also, inflow ports 173 and 183 through which the refrigerant is introduced may be disposed on one side of the inflow-side heads 171 and 181, and discharge ports 174 and 184 through which the refrigerant is discharged may be disposed on the discharge-side heads 172 and 182.

Also, as illustrated in FIG. 2, each of the first and second refrigerant tubes 17 and 18 may have a plate shape with a predetermined width and length. Also, the first and second refrigerant tubes 17 and 18 may be bent several times. Also, the first and second refrigerant tubes 17 and 18 may have a multi-channel refrigerant tube structure in which a plurality of refrigerant channels are disposed in parallel to each other.

Also, the heat-exchange fins may have a structure in which a thin plate having high thermal conductivity and having the same width as each of the refrigerant tubes 17 and 18 is bent or curved several times in a wave form. Also, the heat-exchange fins may be successively disposed in a longitudinal direction between the refrigerant tubes 17 and 18.

Also, cusps of the heat-exchange fins may contact only one side or both sides of the first and second refrigerant tubes 17 and 18. Due to this structure, the air forcibly flowing by the condensation fan 201 may be heat-exchanged with the heat-exchange fins while flowing into channels formed by the bent structure of the heat-exchange fins. The channels may have a lying triangular pillar shape.

The heat-exchange fins may include a first heat-exchange fin of which the cusp contacts only a surface of the first refrigerant tube 17, a second heat-exchange fin 22 of which the cusp contacts only the second refrigerant tube 18, and a sharing heat-exchange fin 23 of which the cusp contacts all of the first and second refrigerant tubes 17 and 18.

In detail, when viewed from one side, the lower cusp and upper cusp of the heat-exchange fins may be alternately disposed. Also, the upper and lower cusps of the first heat-exchange fin 21 may contact only the first refrigerant tube 17. That is, a portion of the refrigerant tube extending in one direction and a portion of the refrigerant tube that is bent in a U shape at a predetermined point to extend in a reverse direction may extend parallel to each other in a state where the portions are spaced a predetermined distance from each other. Then, the first heat-exchange fin 21 may be inserted into the spaced inner space. Thus, the upper and lower cusps of the first heat-exchange fin 21 may contact the surface of the first refrigerant tube 17. Similarly, upper and lower cusps of the second heat-exchange fin 22 may contact a surface of the second refrigerant tube 18.

The sharing heat-exchange fin 23 may be disposed on an area that faces the first and second refrigerant tubes 17 and 18. That is, one of the upper and lower cusps of the sharing heat-exchange fin 23 may contact the surface of the first refrigerant tube 17, and the other may contact the surface of the second refrigerant tube 18.

In the case of the combined condenser 20 having the above-described structure, the heat-exchange fins participating in the heat exchange may change according to the operation mode. That is, the heat-exchange fins participating in the heat-exchange operation are divided according to the operation mode of the refrigerator. Also, the heat-exchange operation may occur over the entire region in a width direction of the heat-exchange fins participating in the heat-exchange operation. Thus, the heat-exchange fins may be improved in availability when compared to that of the case in which the first and second condensers are simply disposed forward and backward in parallel to each other.

FIG. 2 is a view of a state in which all of the first and second refrigeration cycles are in the operation mode. When all of the freezing compartment cooling operation and the refrigerating compartment cooling operation are performed, all of the heat-exchange fins may participate in the heat-exchange operation. That is, heat may be released from the refrigerant tube contacting the corresponding cusps through the cusps of the heat-exchange fins, and then be heat-exchanged with air that forcibly flows by the condensation fan 201.

Figure 3:
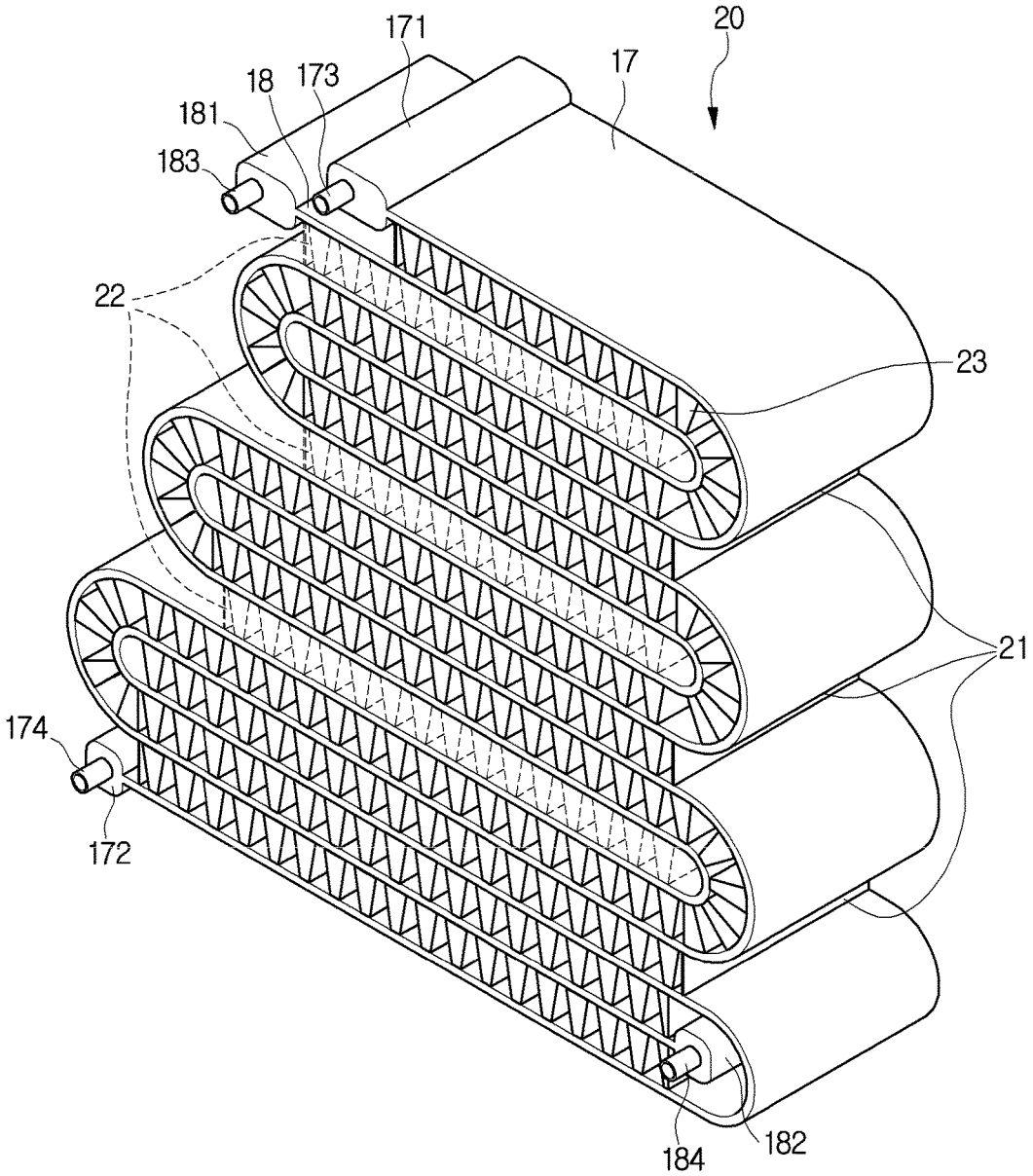
FIG. 3 is a perspective view of the combined condenser for showing heat-exchange fins participating in heat exchange when only a first refrigeration cycle is in an operation mode.

FIG. 3 is a perspective view of the combined condenser for showing the heat-exchange fins participating in heat exchange when only a first refrigeration cycle is in the operation mode.

Referring to FIG. 3, the heat-exchange fins that are expressed as solid lines may represent parts participating in the heat-exchange operation, the heat-exchange fins that are expressed as dotted lines may represent parts that do not participate in the heat-exchange operation.

As illustrated in FIG. 3, when a first refrigeration cycle operates, a high-temperature high-pressure refrigerant flows along the first refrigerant tube 17. Also, heat may be transferred into the first heat-exchange fin 21 contacting a surface of the first refrigerant tube 17. Also, while the air forcibly flowing by the condensation fan 201 passes through the first heat-exchange fin 21, the air may be heat-exchanged with the first heat-exchange fin 21.

Here, parts except for the second heat-exchange fin 22 that does not contact at all the first refrigerant tube 17, i.e., the first heat-exchange fin 21 and the sharing heat-exchange fin 23 may absorb heat from the cusps thereof contacting the first refrigerant tube 17. Also, the heat-exchange fins of which the cusps contact the first refrigerant tube 17 may absorb heat over the entire area in the width direction of the heat-exchange fins and then be heat-exchanged with external air.

Figure 4:
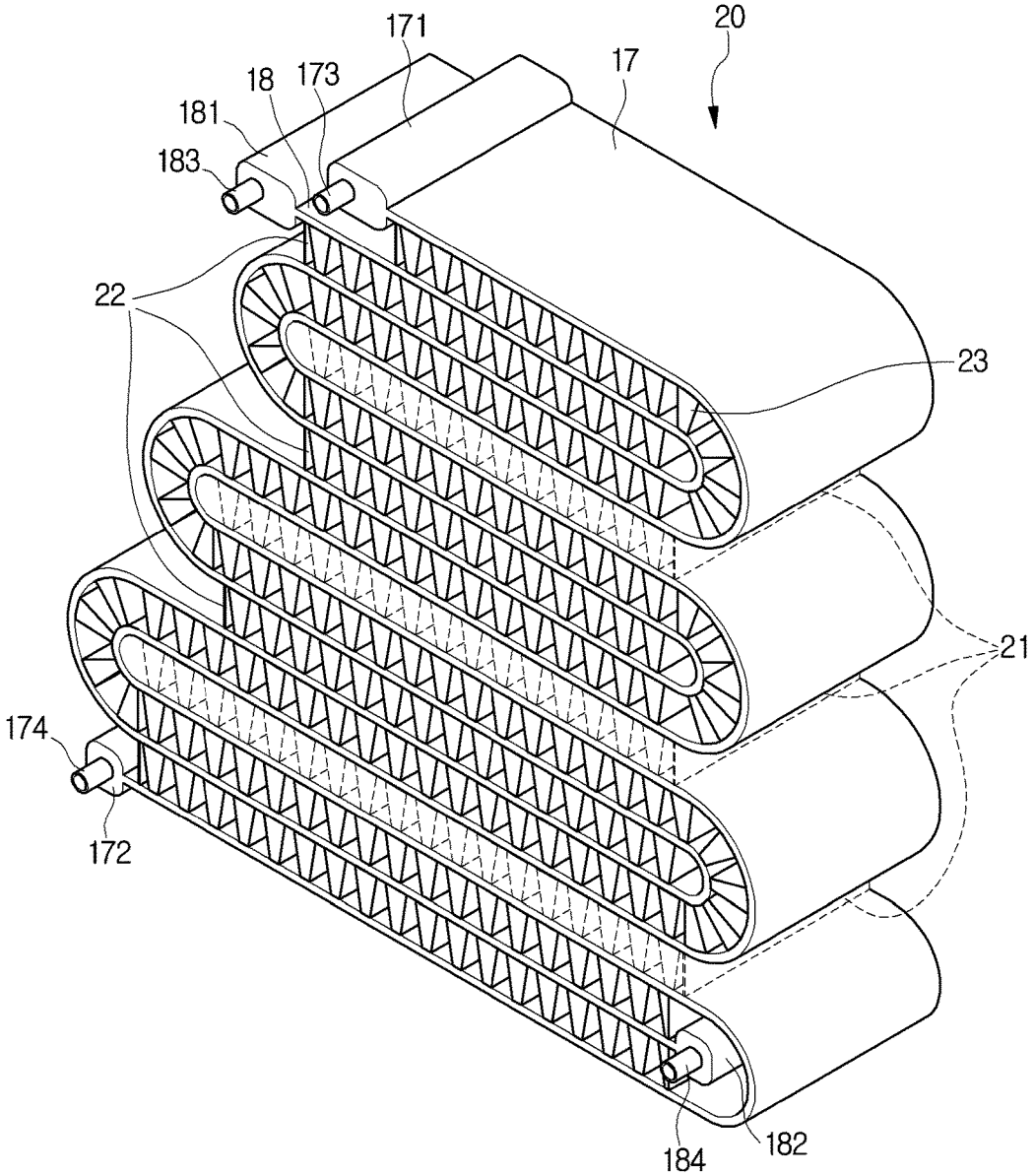
FIG. 4 is a perspective view of the combined condenser for showing heat-exchange fins participating in heat exchange when only a second refrigeration cycle is in an operation mode.

FIG. 4 is a perspective view of the combined condenser for showing the heat-exchange fins participating in heat exchange when only a second refrigeration cycle is in the operation mode.

Referring to FIG. 4, like the case of FIG. 3, the heat-exchange fins that are expressed as solid lines may represent parts participating in the heat-exchange operation, the heat-exchange fins that are expressed as dotted lines may represent parts that do not participate in the heat-exchange operation.

In detail, when a second refrigeration cycle operates, a high-temperature high-pressure refrigerant flows along the second refrigerant tube 18, and the heat-exchange fins contacting the second refrigerant tube 18 participate in the heat-exchange operation. Also, unlike the first refrigeration cycle operation, all of the second heat-exchange fin 22 and the sharing heat-exchange fin 23 except for the first heat-exchange fin 21 contacting only the first refrigerant tube 17 may participate in the heat-exchange operation.

According to the refrigeration cycle of the refrigerator according to the embodiment, the following effects can be obtained.

First, the single-type condenser structure may be adopted for the refrigerator having the two refrigeration cycles to improve utilization efficiency of the machine room.

Second, in the two-cycle structure, the two condensers may be changed in design into the single-type condenser to relatively widen the inner space of the machine room. Thus, the flow resistance of the air for the heat dissipation may be reduced in the machine room.

Third, in the condenser structure according to the embodiment, since the two independent condensation refrigerant tubes share the heat-exchange fin, utilization efficiency of the heat-exchange fin may increase when compared to a case in which the two condensers are disposed in parallel to each other.

That is to say, in the structure in which the two independent condensers are disposed in parallel to each other, if only one of the two cycles operates, the heat-change fin of the condenser in the refrigeration cycle that does not operate may not perform the heat-dissipation operation.

However, according to the embodiment, since the two independent condensation tubes share at least one portion of the heat-exchange fins, even though only one refrigeration cycle operates, the whole heat-exchange fins contacting the condensation tube in which the refrigerant flows may perform the heat-dissipation operation. Thus, the heat-dissipation amount of the condenser may increase to improve the heat-dissipation efficiency.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigeration cycle of a refrigerator comprising a first refrigeration cycle in which a first refrigerant flows along a first refrigerant tube, the first refrigerant being configured to cool one of a refrigerating compartment or a freezing compartment and a second refrigeration cycle in which a second refrigerant flows along a second refrigerant tube, the second refrigerant being configured to cool the other of the refrigerating compartment or the freezing compartment, the refrigeration cycle comprising:

a first compressor configured to compress the first refrigerant into a high-temperature high-pressure gaseous refrigerant, and a second compressor configured to compress the second refrigerant into a high-temperature high-pressure gaseous refrigerant;

a combined condenser condensing each of the first refrigerant passing through the compressor and the second refrigerant passing through the second compressor into a high-temperature high-pressure liquid refrigerant;

a first expansion valve configured to change a phase of the first refrigerant passing through the combined condenser into a low-temperature low-pressure two-phase refrigerant, and a second expansion valve configured to change a phase of the second refrigerant passing through the combined condenser into a low-temperature low-pressure two-phase refrigerant; and a first evaporator configured to change the first refrigerant passing through the first expansion valve into a low-temperature low-pressure gaseous refrigerant, and a second evaporator configured to change the second refrigerant passing through the second expansion valve into a low-temperature low-pressure gaseous refrigerant, wherein the combined condenser comprises:

a first condensation tube that is a portion of the first refrigerant tube that connects the first compressor to the first expansion valve;

a second condensation tube that is a portion of the second refrigerant tube that connects the second compressor to the second expansion valve; and a plurality of heat-exchange fins contacting one of or both surfaces of the first and second condensation tubes, wherein the first and second condensation tubes share at least a portion of the heat- exchange fins, wherein each of the first and second condensation tubes has a shape of a flat tube with a predetermined width and length, wherein the first and second condensation tubes are vertically spaced apart from each other and are disposed in parallel to each other, wherein the first condensation tube comprises a plurality of first bent portions that are bent or rounded a first number of times, and a plurality of first flat portions, each first flat portion extending from one of the plurality of first bent portions to form a first meander line, wherein the second condensation tube comprises a plurality of second bent portions that are bent or rounded a second number of times, and a plurality of second flat portions, each second flat portion extending from one of the plurality of second bent portions to form a second meander line, wherein the plurality of heat-exchange fins are inserted in-between the first and second condensation tubes that are vertically adjacent thereto, wherein each heat-exchange fin is bent several times in a wave form to define upper cusps and lower cusps at bent portions of the heat-exchange fin, wherein the upper cusps and lower cusps of the plurality of heat-exchange fins contact one of or both surfaces of the first and second condensation tubes, and wherein, the plurality of heat-exchange fins include, in a stand-alone operation mode of the first refrigeration cycle or the second refrigeration cycle, first parts that performs heat-exchange operation and second parts that do not participate in the heat-exchange operation, and wherein a number of the plurality of first flat portions is different from a number of the plurality of second flat portions.

2. The refrigeration cycle according to claim 1, wherein each of the heat-exchange fins has the same width as that of each of the first and second condensation tubes.

3. The refrigeration cycle according to claim 1, wherein the heat-exchange fins comprise:

a first heat-exchange fin in which all of the upper and lower cusps contact the surface of the first condensation tube;

a second heat-exchange fin in which all of the upper and lower cusps contact the surface of the second condensation tube; and a sharing heat-exchange fin in which one cusp of the upper and lower cusps contacts the surface of the first condensation tube, and the other cusp contacts the surface of the second condensation tube.

4. The refrigeration cycle according to claim 3, wherein, in a stand-alone operation mode of the first refrigeration cycle, heat exchange is performed through the first heat-exchange fin and the sharing heat-exchange fin, in a stand-alone operation mode of the second refrigeration cycle, the heat exchange is performed through the second heat-exchange fin and the sharing heat-exchange fin, and in a simultaneous operation mode of the first and second refrigeration cycles, the heat exchange is performed through all of the heat-exchange fins.

5. The refrigeration cycle according to claim 1, wherein the first and second condensation tubes have the same width.

6. The refrigeration cycle according to claim 5, further comprising:

a first inflow-side head connected to one end of the first condensation tube and configured to distribute the first refrigerant into the first condensation tube;

a second inflow-side head connected to one end of the second condensation tube and configured to distribute the second refrigerant into the second condensation tube;

a first inflow port disposed on one side of the first inflow-side head and connected to the first refrigerant tube that extends from the first compressor;

a second inflow port disposed on one side of the second inflow-side head and connected to the second refrigerant tube that extends from the second compressor;

a first discharge-side head connected to the other end of the first condensation tube and configured to collect the first refrigerant flowing along the first condensation tube;

a second discharge-side head connected to the other end of the second condensation tube and configured to collect the second refrigerant flowing along the second condensation tube;

a first discharge port disposed on one side of the first discharge-side head and connected to the first expansion valve; and a second discharge port disposed on one side of the second discharge-side head and connected to the second expansion valve.

7. The refrigeration cycle according to claim 1, wherein one of the first and second evaporators is a refrigerating compartment evaporator, and the other of the first and second evaporators is a freezing compartment evaporator.

8. The refrigeration cycle according to claim 1, wherein the first and second refrigerants are a same type of refrigerant.

9. The refrigeration cycle according to claim 1, wherein the plurality of first flat portions include:

a first pair of first flat portions that are disposed vertically above two of the plurality of second flat portions;

a second pair of first flat portions that are disposed vertically below the two of the plurality of second flat portions; and a third pair of first flat portions that are disposed vertically above only one of the plurality of second flat portions.

10. The refrigeration cycle according to claim 1, wherein the first number of times that the plurality of first bent portions are bent or rounded is different from the second number of times that the plurality of second bent portions are bent or rounded.

11. The refrigeration cycle according to claim 1, wherein a number of the plurality of first bent portions is greater than a number of the plurality of second bent portions.

12. The refrigeration cycle according to claim 1, wherein the first condensation tube has a first inlet configured to receive the first refrigerant and a first outlet configured to discharge the first refrigerant, wherein the second condensation tube has a second inlet configured to receive the second refrigerant and a second outlet configured to discharge the second refrigerant, wherein the first inlet of the first condensation tube and the second inlet of the second condensation tube are both located at a first lateral side of the combined condenser, wherein the first outlet of the first condensation tube is located at the first lateral side, and wherein the second outlet of the second condensation tube is located at a second lateral side opposite to the first lateral side.

13. The refrigeration cycle according to claim 12, wherein a lateral distance between the first outlet of the first condensation tube and the second outlet of the second condensation tube is greater than a lateral distance between the first inlet of the first condensation tube and the second inlet of the second condensation tube.

14. The refrigeration cycle according to claim 6, wherein the first inflow-side head and the second inflow-side head are both located at a first lateral side of the combined condenser, wherein the first discharge-side head is located at the first lateral side, and wherein the second discharge-side head is located at a second lateral side opposite to the first lateral side.

15. The refrigeration cycle according to claim 14, wherein a lateral distance between the first discharge-side head and the second discharge-side head is greater than a lateral distance between the first inflow-side head and the second inflow-side head.

* * * * *